United States Patent [19]

Mourier

[11] 3,970,971

[45] July 20, 1976

[54] PARASITIC WAVE ATTENUATOR USEABLE IN HIGH FREQUENCY ELECTRONIC TUBES

[75] Inventor: Georges Mourier, Paris, France

[73] Assignee: Thomson-CSF, Paris, France

[22] Filed: June 5, 1975

[21] Appl. No.: 583,970

[30] Foreign Application Priority Data

June 11, 1974 France ..... 71.20155

[52] U.S. Cl. ..... 333/81 R; 315/39; 315/39.51; 333/98 M

[51] Int. Cl.[2] ..... H01P 1/22

[58] Field of Search..... 333/81 R, 81 B, 98 M; 315/5.21, 39.51, 39.55, 39.77, 39

[56] References Cited

UNITED STATES PATENTS

| | | | |
|---|---|---|---|
| 3,049,683 | 8/1962 | Foster et al. | 333/81 R |
| 3,636,403 | 1/1972 | Edwards et al. | 315/39.77 X |
| 3,882,427 | 5/1975 | Pflanz | 333/81 R X |

*Primary Examiner*—Paul L. Gensler
*Attorney, Agent, or Firm*—Roland Plottel

[57] ABSTRACT

A device for attenuating very short parasitic waves which create surface currents at the surface of a conductive wall of a high frequency circuit, said device comprising within an opening provided in the wall, a highly resistive element exhibiting magnetic losses; the surface currents which form a loop around said element, generate therethrough an alternating magnetic field providing magnetic losses which attenuate said parasitic waves.

8 Claims, 8 Drawing Figures

PARASITIC WAVE ATTENUATOR USEABLE IN HIGH FREQUENCY ELECTRONIC TUBES

The present invention relates to a device and various embodiments thereof, which can be utilised in high frequency circuits in order to damp parasitic electromagnetic waves there, said circuits for example being parts of electronic tubes.

It is well-known to damp parasitic oscillations developing in electronic tubes, for example by introducing into the relevant part of the tube highly damped oscillatory circuits, or again by arranging such circuits in the tube load circuits. Such circuits have several drawbacks. In particular, they operate within a narrow frequency band since they are resonant circuits; this requires the use of several different oscillatory circuits if several different parasitic resonances are involved, this procedure being expensive and often impossible in fact, in view of the small amount of space available within electronic tubes. They also increase the number of resonances, and this is undesirable.

The attenuator devices in accordance with the present invention are absorber devices having no resonance within the operating band of the high frequency circuits to which they are fitted. They are therefore capable of damping parasitic waves of different frequencies.

Moreover, they are arranged in the conductive walls of the circuits to which they are fitted, so that they do not increase the bulk thereof at all; they are easy to manufacture and easy to install.

Devices of this kind, since they are capable of absorbing electromagnetic waves, very short waves or microwaves, throughout the band width of the circuits to which they are fitted, must of course be arranged in said circuits in such a fashion as to absorb only the parasitic waves and not to attenuate the useful waves which the circuits pass.

According to the invention, there is provided a device for attenuating very short parasitic waves generating surface currents at a surface 3 of a conductive wall 1 of a high frequency circuit, said device comprising an element 6 made of a material which is electrically nonconductive and which exhibits magnetic losses when subjected to an alternating magnetic field, said element 6 being arranged in an opening 4 formed in said conductive wall 1, said opening being so designed and disposed related to said conductive wall that it creates an electrical discontinuity at said surface 3 of said wall 1, said surface electrical discontinuity forcing said surface currents to make a loop around said element 6, said current loop generating inside said element 6 an alternating magnetic field H.

Figure 1:
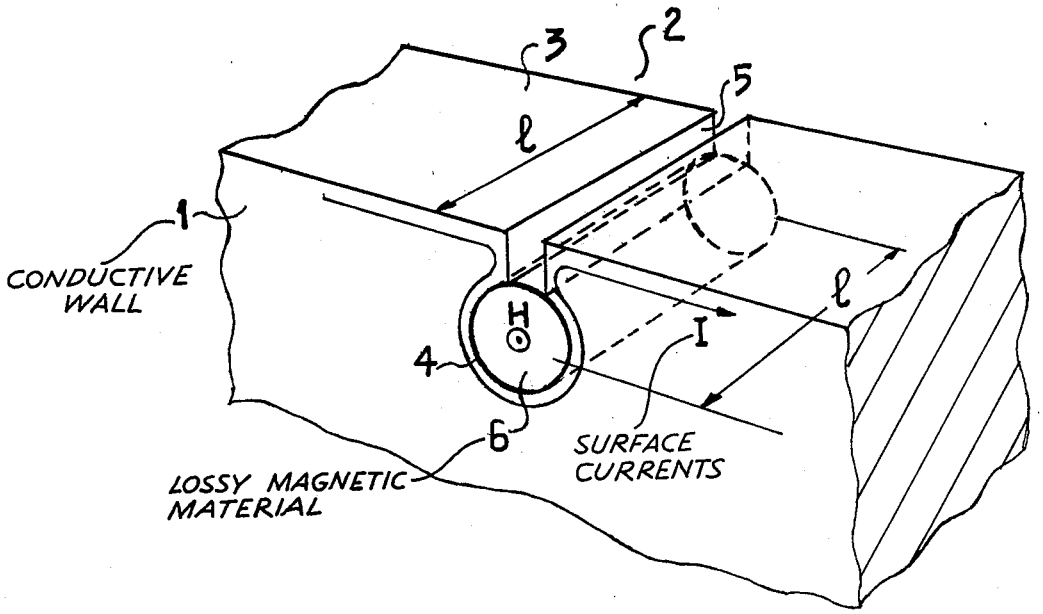
Figure 2:
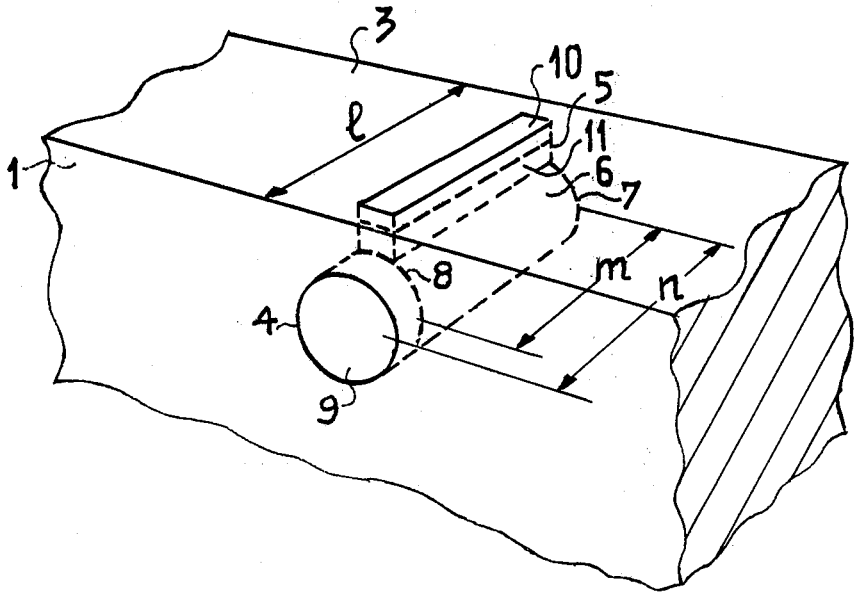
Figure 5A:
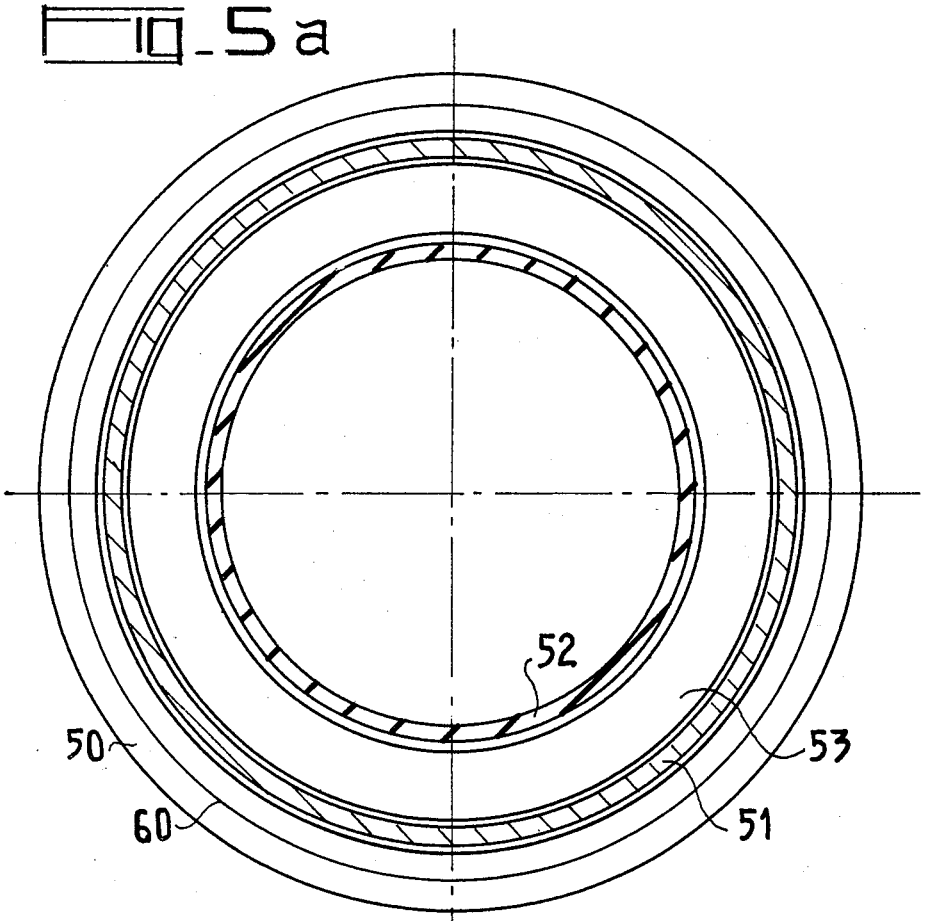
Figure 5B:
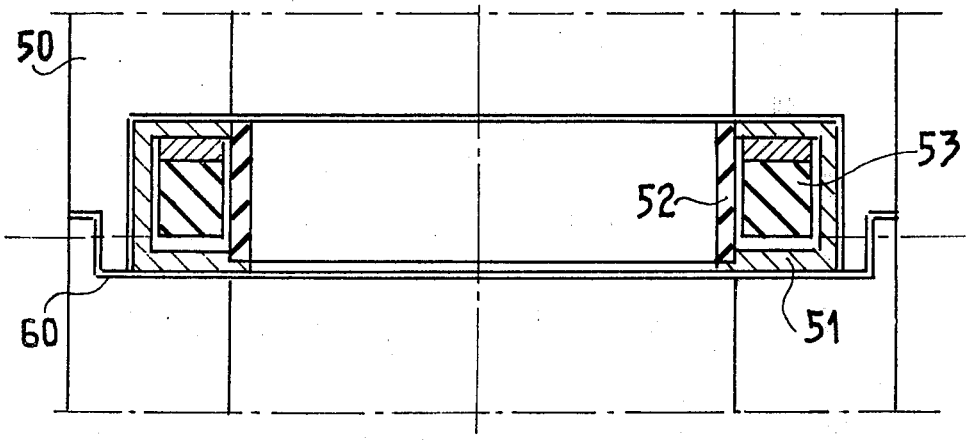

The invention, as well as illustrative embodiments, will now be described, reference being directed to the accompanying drawings in which:

FIGS. 1 and 2 are schematic perspective view of parts of high frequency circuits equipped with attenuator devices in accordance with the invention;

FIGS. 3*a* and 3*b*, 4*a* and 4*b* are schematic sectional views of variant embodiments of the attenuator devices in accordance with the invention;

FIGS. 5*a* and 5*b* are schematic sectional views of another embodiment of attenuator devices in accordance with the invention, which is of particular significance in application to electronic tubes having cylindrical high frequency circuit sections.

FIG. 1 schematically illustrates part of a conductive wall 1 of a high frequency circuit equipped with a wave attenuator device in accordance with the invention.

The parasitic electromagnetic waves present in the space 2 in contact with the surface 3 of said wall, develop there high frequency currents which, conventionally, due to the skin effect, very little penetrate into the wall thickness. If, as is the case here, the parasitic waves are very short waves, possibly even microwaves, then this penetration is of the order of some few microns and it is the convention then to talk of surface currents.

An elongated opening is formed of the wall 1; this opening consists for example of a cylindrical opening 4 which can pass through the wall from one side to the other as FIG. 1 shows, and terminates towards the surface 3 in a parallelepiped opening 5. In the cylindrical opening 4 an element 6 is placed whose dimensions correspond with those of the opening 4 so that there is a good thermal contact between the element 6 and the walls of said opening 4.

Said element 6 is a cylinder of a material having very high resistivity in order to force the surface currents, I for example, to flow along the walls of the opening 4. The current loop thus constituted creates a magnetic field H parallel to the generatrices of the cylinder 4.

The material of which the element 6 is made is on the other hand chosen, from among the range of materials which have high resistivity, in order to exhibit substantial magnetic losses when subjected to an alternating magnetic field; materials fulfilling this qualification would for example be ferrites or garnets.

Thus, the magnetic field H created by the current loop I generates in the element 6 magnetic losses which are translated into terms of thermal energy developed in the body of the element 6. This thermal energy is dissipated through the walls of the opening 4, to the wall 1.

The parasitic electromagnetic waves are thus attenuated. It is clear that the greater the length $l$ of the element 6 the greater are the magnetic losses and the more the parasitic waves are attenuated.

FIG. 2 illustrates a variant embodiment of the preceding device in which, in order to prevent the material of which the element 6 is made from liberating gas into the circuit to which it is fitted, when it is heated as a consequence of its magnetic losses, (this is a phenomenon which could occur with ferrites) the element 6 is enclosed in a gastight enclosure. For this purpose, for example, the cylindrical opening 4 in which the element 6 is located has a length $n$ shorter than the dimension $l$ of the wall 1 to which it is fitted, and the element 6 itself has a length $m$ less than that $n$ of the opening 4. Whereas the end 7 of the element 6 seats against a gastight part of the wall 1, a plug 9 closes off the open end of the opening 4 in gastight fashion and comes up against the end 8 of the element 6. Finally, a parallelepiped plug 10 of insulating material, for example a ceramic, having a length $m$ like the opening 5, closes off said latter opening in gastight fashion.

The gases which may be liberated when the element 6 is heated, are thus trapped in the sealed enclosure 11 defined between the element 6 and the plugs 10 and 9.

Figure 3A:
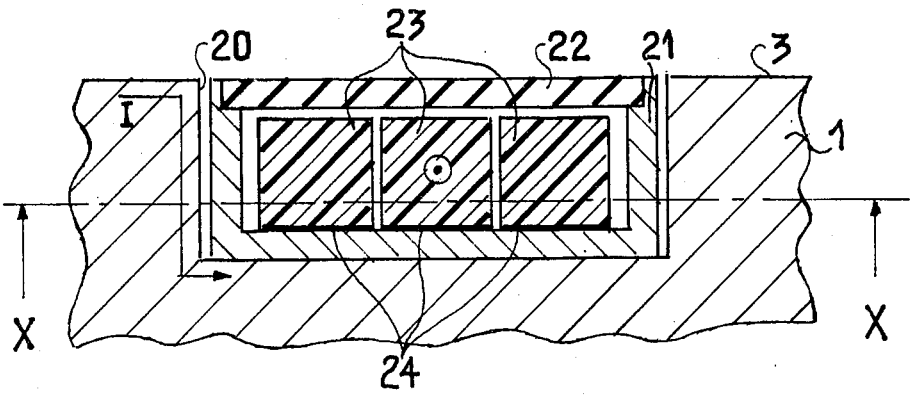
Figure 3B:
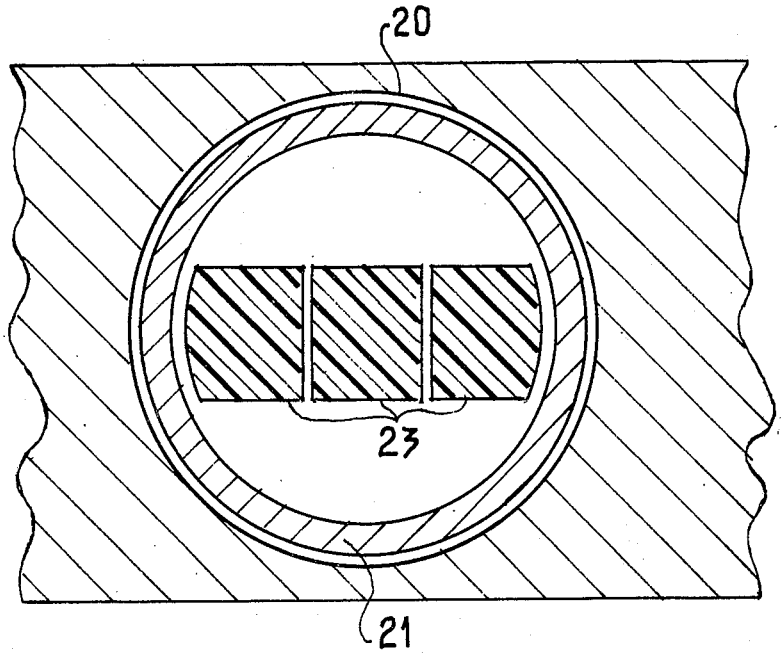

FIGS. 3*a* and 3*b* illustrate in section a variant embodiment of the damping device in accordance with the invention in which said device involves a slightly more elaborate technology, improving its efficiency and facilitating its positioning in a wall 1 through which high frequency surface currents I requiring attenuation are flowing.

The device here consists of a cylindrical gastight enclosure, partly metallic 21 and partly insulating 22, arranged in the cylindrical opening 20 formed in the wall 1, said enclosure containing the magnetic loss insulating element constituted here by several ferrite blocks 23 brazed at 24 to the metal base 21 of the gastight enclosure.

The diameter of the enclosure 21 is slightly smaller than that of the opening 20 so that when the ferrite blocks 23 are heated, differences in expansion on the part of the different components of the enclosure do not produce mechanical stresses of the kind which could cause rupture of the device and in particular of the insulating cover 22. It is for these same reasons that the magnetic loss element is constituted by several blocks 23.

The mode of operation is the same as before; the high frequency surface currents I of the surface 3 form a loop beneath the device in accordance with the invention, developing a magnetic field H which produces magnetic losses. The resultant heat is dissipated by the metal base of the enclosure 21 to the wall 1.

Figure 4A:
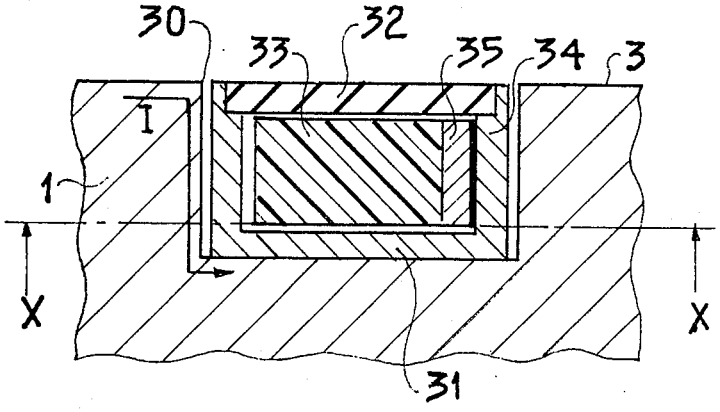
Figure 4B:
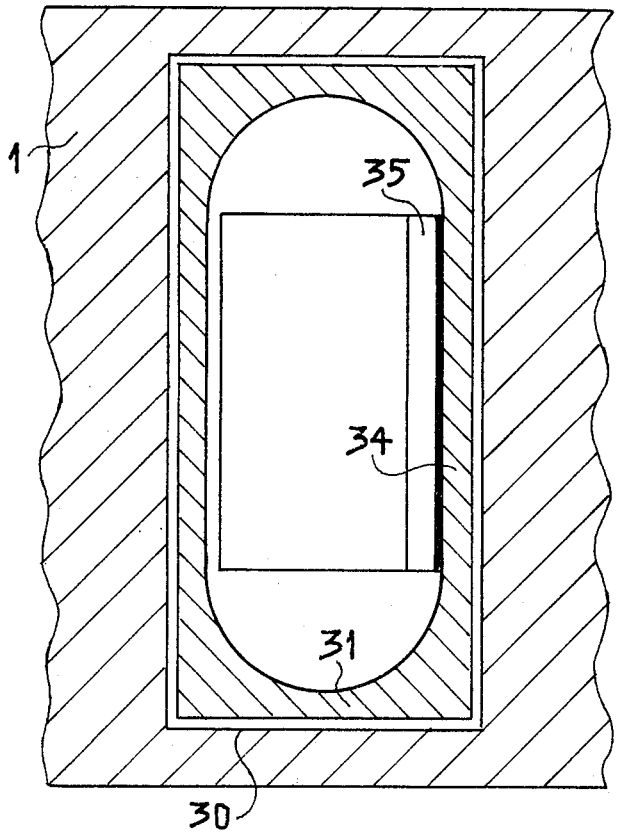

FIGS. 4*a* and 4*b* illustrate in section a variant embodiment of the device shown in FIG. 3, differing from the latter on the one hand in terms of the dimensions of the enclosure containing the magnetic loss element, and on the other in terms of the design and attachment of the magnetic loss element 33.

The enclosure 31, 32 and the opening 30 in which it is located and fixed, for example by brazing or welding at the base, are rectangular in order to prevent the possibility that part of the surface currents I will not flow around the opening 30 at the surface but instead flow beneath the attenuator device; this kind of bypassing on the part of some of the current flowing around the opening, would reduce the attenuated effect of the device, and that of course would be undesirable.

As far as the element 33 is concerned, it is constituted by a single block of ferrite for example and is brazed to a side wall 34 of the enclosure 31. The attachment can be effected, as is the case here, through the agency of a metal component 35 to which the element has previously been brazed. This component 35 improves the thermal contact between the element 33 and the wall 34 of the gastight enclosure.

Mechanical clearances are also provided here in order to ensure that mechanical stresses do not bring about cracking of the device.

FIGS. 5*a* and 5*b* illustrate in section a variant embodiment of the device shown in FIG. 4, designed for installation in a cylindrical wall 50 of a high frequency circuit.

The cylindrical wall may for example be a cylindrical electrode of a high frequency or microwave tube, as for example the anode of a tetrode with coaxially disposed cylindrical electrodes. It could also be the external conductor of the cathode connection of a magnetron.

Devices such as those illustrated in preceding FIGS. 1 to 4 can, of course, be arranged on such cylindrical walls. The advantage of that shown in FIGS. 5*a* and 5*b* is that the whole of the surface current is obliged to flow in a loop around the magnetic loss element, and that the desired attenuated effect is then at a maximum.

The attenuating device is identical to that of FIG. 4 (it could also be of the type shown in FIG. 3), with the exception of its cylindrical shape. It comprises a gastight enclosure, partly metallic 51, partly insulating 52, and a magnetic loss element 53.

The cylindrical wall 50 to which it is fitted is open at 60 for the installation of the cylindrical attenuation device, and is then closed off and welded or brazed.

What is claimed is:

1. A device for attenuation very short parasitic waves generating surface currents at a surface of a conductive wall of a high frequency circuit, said device comprising an element made of a material which is electrically non-conductive and which exhibits magnetic losses when subjected to an alternating magnetic field, said element being arranged in an opening formed in said conductive wall, said opening being so designed and disposed related to said conductive wall that it creates an electrical discontinuity at said surface of said wall, said surface electrical discontinuity forcing said surface currents to make a loop around said element, said current loop generating inside said element an alternating magnetic field.

2. An attenuator device according to claim 1, wherein said material is a ferrite.

3. An attenuator device according to claim 2, wherein said opening is elongated parallel to said surface, said ferrite element being a ferrite bar located in said opening and in contact with the walls thereof.

4. An attenuator device according to claim 3, wherein said opening containing said ferrite bar is hermetically sealed.

5. An attenuator device according to claim 1, wherein said element is enclosed in a gastight enclosure itself arranged in said opening.

6. An attenuator device according to claim 5, wherein said gastight enclosure is metallic at least at that of its parts in contact with the base of said opening, and that of its parts closing said opening is an insulator.

7. An attenuator device according to claim 6, wherein said element is in contact with the metal part of said enclosure.

8. An attenuator device according to claim 5 designed to attenuate surface currents created at the surface of a conductive cylindrical wall, wherein said opening, said enclosure and said element are rings disposed perpendicularly to the longitudinal axis of said wall.

* * * * *